US006626531B2

(12) United States Patent
Fujii et al.

(10) Patent No.: US 6,626,531 B2
(45) Date of Patent: Sep. 30, 2003

(54) INK JET RECORDING MEDIUM FOR PIGMENT INK AND INK JET RECORDING METHOD

(75) Inventors: Hiroyuki Fujii, Ichihara (JP); Yasumasa Yukawa, Ichihara (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 10/118,954

(22) Filed: Apr. 10, 2002

(65) Prior Publication Data

US 2002/0196322 A1 Dec. 26, 2002

(30) Foreign Application Priority Data

Apr. 11, 2001 (JP) ..... 2001-112679
Apr. 26, 2001 (JP) ..... 2001-129828

(51) Int. Cl.[7] ..... B41J 2/01
(52) U.S. Cl. ..... 347/105; 347/101; 428/95
(58) Field of Search ..... 347/105, 101, 347/100; 428/195

(56) References Cited

U.S. PATENT DOCUMENTS 5,397,619 A * 3/1995 Kuroyama et al. ..... 347/105
5,567,513 A * 10/1996 Takeuchi et al. ..... 347/105
5,858,555 A * 1/1999 Kuroyama et al. ..... 428/537
5,985,076 A * 11/1999 Misuda et al. ..... 156/230
6,074,467 A * 6/2000 Tabayashi et al. ..... 106/31.65
6,187,419 B1 * 2/2001 Kijimuta et al. ..... 428/195
6,342,289 B1 * 1/2002 Eguchi et al. ..... 428/195
6,410,123 B1 * 6/2002 Otani et al. ..... 428/195

FOREIGN PATENT DOCUMENTS

| | | |
|---|---|---|
| GB | 2 316 890 | 3/1998 |
| JP | 9-123593 | 5/1997 |
| JP | 10-119422 | 5/1998 |
| JP | 10-166717 | 6/1998 |
| JP | 11-78225 | 3/1999 |

* cited by examiner

*Primary Examiner*—Judy Nguyen
*Assistant Examiner*—Manish S. Shah
(74) *Attorney, Agent, or Firm*—Oblon, Spivak, McClelland, Maier & Neustadt, P.C.

(57) ABSTRACT

An ink jet recording medium for pigment ink, which includes a substrate and a porous ink receiving layer for pigment ink, formed on the surface of the substrate, wherein the ink receiving layer includes a pigment and a binder and has an average surface roughness (Ra) according to JIS B0601 of from 0.2 to 2.0 $\mu$m.

10 Claims, 1 Drawing Sheet

INK JET RECORDING MEDIUM FOR PIGMENT INK AND INK JET RECORDING METHOD

Figure 1A:
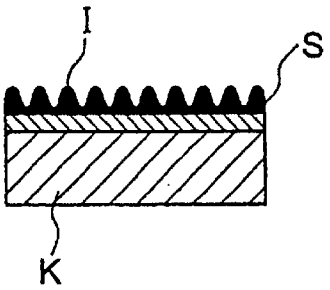

The present invention relates to an ink jet recording medium for pigment ink, which is excellent in color reproducibility such as developed color density, contrast and color tone and has an excellent pigment fixing property, and a recording method therefor.

Along with rapid dissemination of digital cameras, or computers, hard copy technologies to record prints or images output therefrom on paper sheets, etc., have been rapidly developed. Thus, it has now been possible to obtain quality and performance close to the objective levels of silver salt photographs with respect to color reproducibility, image density, gloss, weather resistance, etc. As such recording systems for hard copies, an ink jet system, a sublimation type thermal transfer system and an electrostatic transfer system may, for example, be mentioned as typical examples.

Among them, the ink jet system has merits in that the apparatus is relatively small in size, and the running cost is low, and together with the sublimation type thermal transfer system or the like, it is considered to be the main system for hard copies. The ink jet system is a system wherein ink droplets comprising a colorant and a large amount of a medium, are jetted at a high speed from a nozzle to a recording medium. Printers of such ink jet system have become widely used in recent years, since full color and high speed are thereby easy, and printing noises are thereby low.

As a colorant for ink in the ink jet recording system, it has been common in most cases to employ a water-soluble dye excellent in color reproducibility (Gamut). However, such a dye ink has had a difficulty in fastness including light resistance and water resistance. Therefore, recently, it has been proposed to use a pigment ink wherein the colorant is a pigment, which is already been widely used. With the pigment ink, the above-mentioned difficulty in light resistance, water resistance, etc. which used to be a problem with a conventional dye ink, can be solved, and ink running as observed when a dye ink is used for printing on a recording sheet, can be remarkably minimized.

Further, the pigment ink is basically the same coloring material as the ink used in plate printing such as offset printing or gravure printing, and since the hue of the developed color is similar, it can be used also as a so-called color proof in test printing for color correction in such plate printing.

However, when a pigment ink is used for printing on a recording medium such as paper which is used for a conventional dye ink, there has been a problem that the color reproducibility such as the developed color density, contrast or color tone, tends to be inadequate, or the ink tends to be easily removed when the printed portion or the image portion is rubbed after being printed. Further, in contrast with a dye ink wherein a dye is dissolved in water, a pigment ink is one wherein fine particulate water-insoluble pigment particles are dispersed in a medium such as water and thus has a problem that as the medium evaporates, abnormal jetting is likely to occur due to an increase of the viscosity of the ink in the vicinity of the ink jet nozzle, and in the worst case, clogging of the nozzle is likely to result.

In recent years, there have been proposals for means to solve such difficulties in ink jet printing employing such a pigment ink, for example, in JP-A-11-78225, JP-A-10-119422, JP-A-10-166717 and JP-A-9-123593. Among them, JP-A-11-78225 proposes an ink jet recording medium wherein in order to improve fixing of a pigment ink, on an ink-receiving layer formed on a paper substrate, a pigment fixing layer having a certain specific physical property is further formed. However, due to the multilayer structure, the production tends to be correspondingly cumbersome, and the cost increases accordingly.

It is an object of the present invention to provide an ink jet recording medium for pigment ink having an ink-receiving layer on the surface of a substrate, which is excellent in the color reproducibility such as the developed color density, contrast and color tone and which has an adequate pigment ink fixing property in the ink-receiving layer without necessity of forming a special pigment fixing layer, while maintaining merits of using a pigment ink, such as light resistance, water resistance and little running, and an ink jet recording method employing such a recording medium.

The present inventors have conducted various researches to accomplish the above object and as a result, have found that as between ink jet printing employing a pigment ink and ink jet printing employing a conventional dye ink, the natures and characteristics of the respective inks are different, and accordingly, totally different characteristics are required for recording media used for the respective printing methods. Namely, FIGS. 1 and 2 are enlarged cross-sectional views of recording media, which schematically illustrate the respective behaviors of colorants (S) in the case of a dye ink and in the case of a pigment ink, when ink jet printing was carried out by using recording media having different surface conditions of the ink-receiving layers.

When ink jet printing is carried out by using three types of recording media i.e. a recording medium (A) having an ink receiving layer having a high surface roughness, a recording medium (B) having an ink receiving layer having an intermediate surface roughness and a recording medium (C) having an ink receiving layer having a smooth surface, in the ink jet printing employing a conventional dye ink as shown in FIG. 1, the colorant (S) made of a dye is dissolved in a medium such as water constituting the ink and therefore will penetrate together with the ink medium into the interior of the recording medium immediately upon printing and will settle on the surface or in the surface layer of the ink receiving layer (I) of the recording medium.

As a result, the quality of prints or images formed by the ink jet printing by a dye ink is such that when the surface of the ink receiving layer is very rough as in the recording medium (A), the developed color density is low, and the gloss is low, and in the case of the intermediate surface roughness as the recording medium (B), the developed color density is moderate, and the gloss is also moderate. Whereas, in the case of an ink receiving layer having a high surface smoothness as in the recording medium (C), excellent prints and images can be obtained where the developed color density is high and the gloss is also high.

On the other hand, in the case of ink jet printing by a pigment ink, the colorant (S) made of a pigment is in a dispersed state as fine particles without being dissolved in an ink medium, and when the pigment ink is printed, while the ink medium will penetrate into the interior of the recording medium, the colorant will not penetrate into the interior of the recording medium and will deposit on the surface or in the vicinity of the surface of the ink receiving layer (I) of the recording medium.

In such a case, when the ink receiving layer has a high surface smoothness as in the recording medium (C), there is no so-called anchor effect, and pigment particles of the colorant merely deposit on the surface of the recording medium, whereby no adequate fixing property can be obtained, and they are likely to fall off even by slight abrasion. Further, the resulting images tend to have a metallic gloss, thus leading to a so-called bronzing phenomenon. On the other hand, in a case where the ink receiving layer has a rough surface as in the recording medium (A), the pigment particles as the colorant will be embedded in the roughened surface of the ink receiving layer, whereby only part of pigment ink particles will be exposed on the surface, whereby the developed color density tends to be low. Thus, in the case of ink jet printing by a pigment ink, when the ink receiving layer has an intermediate suitable surface roughness as in the recording medium (B), the pigment particles will be properly fixed on the surface, whereby the developed color density will be sufficient and a high quality where they will not be removed even by abrasion, can be obtained.

The present invention has been made as a result of combining the above findings with the surface characteristics of the ink receiving layer of a recording medium, and has the following construction.

(1) An ink jet recording medium for pigment ink, which comprises a substrate and a porous ink receiving layer for pigment ink, formed on the surface of the substrate, wherein the ink receiving layer comprises a pigment and a binder and has an average surface roughness (Ra) according to JIS B0601 of from 0.2 to 2.0 $\mu$m (2) An ink jet recording method employing a pigment ink, which comprises ink jet printing a pigment ink to an ink jet recording medium which comprises a substrate and a porous ink receiving layer for pigment ink, formed on the surface of the substrate, wherein the ink receiving layer comprises a pigment and a binder and has an average surface roughness (Ra) according to JIS B0601 of from 0.2 to 2.0 $\mu$m.

On the other hand, the present inventors have found that as the surface characteristics of the ink receiving layer, when the specular gloss at 20° and the distinctness of image gloss of the surface are within certain specific ranges, pigment particles will be properly fixed on the surface, whereby the developed color density will be adequate, and a high quality where pigment particles will not be removed even by abrasion, will be obtained. This is considered to be explained in such a way that when the surface of the ink receiving layer has the above-described characteristics, in the ink jet printing by a pigment ink, the ink receiving layer as in the above-mentioned recording medium (B) has a proper surface roughness of an intermediate level.

Thus, the present invention is made based on the above discovery and has the following construction.

(3) An ink jet recording medium for pigment ink, which comprises a substrate and a porous ink receiving layer for pigment ink, formed on the surface of the substrate, wherein the ink receiving layer comprises a pigment and a binder, and the surface of the ink receiving layer has a specular gloss at 20° of from 2 to 18% and a distinctness of image gloss of at most 20.

(4) An ink jet recording method employing a pigment ink, which comprises ink jet printing a pigment ink to an ink jet recording medium which comprises a substrate and a porous ink receiving layer for pigment ink, formed on the surface of the substrate, wherein the ink receiving layer comprises a pigment and a binder, and the surface of the ink receiving layer has a specular gloss at 20° of from 2 to 18% and a distinctness of image gloss of at most 20.

Figure 1B:
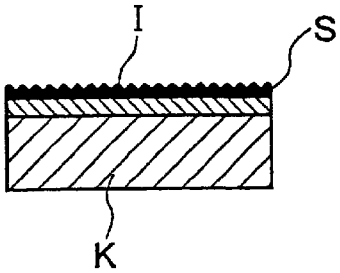
Figure 1C:
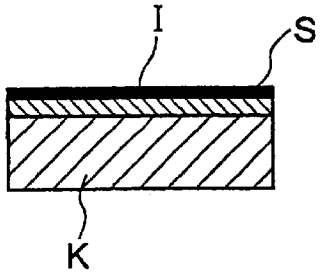

In the accompanying drawings:

FIGS. 1(A) to (C) are enlarged cross-sectional views schematically illustrating the behaviors of the respective colorants (S), when ink jet printing was carried out to three types of recording media differing in the surface conditions of the respective ink receiving layers, by using a conventional dye ink.

Figure 2A:
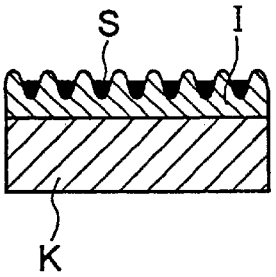
Figure 2B:
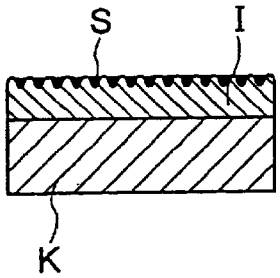
Figure 2C:
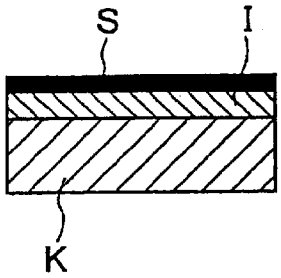

FIGS. 2(A) to (C) are enlarged cross-sectional views schematically illustrating the behaviors of the respective colorants (S), when ink jet printing was carried out to three types of recording media differing in the surface conditions of the respective ink receiving layers, by using a pigment ink of the present invention.

In the figures, A indicates a recording medium having an ink receiving layer having a high surface roughness, B a recording medium having an ink receiving layer having an intermediate surface roughness, C a recording medium having an ink receiving layer having a smooth surface, K a substrate, I an ink receiving layer, and S a colorant in an ink made of a dye or a pigment.

In the present invention, the ink jet recording medium comprises a substrate preferably of a sheet shape and an ink receiving layer formed thereon. The material for the substrate is not particularly limited, and papers, plastics, ceramics or metals may, for example, be used. Preferably, a paper substrate comprising pulp as the main component, is used. As the paper substrate, it is suitable to use one which contains preferably at least 70 mass %, more preferably at least 80 mass %, of pulp. Preferably, acid paper, acid free paper or coated paper which has ink absorptivity and which is commonly used in a coated paper field, may be used.

As the pulp constituting the paper substrate, it is preferred to use a natural pulp comprising, as the main component, softwood pulp, hardwood pulp or a mixture of softwood pulp and hardwood pulp. Such a pulp is preferably used in a state of bleached pulp such as craft pulp, sulfite pulp or soda pulp. Further, a paper substrate having a synthetic fiber or a synthetic pulp incorporated in addition to such a natural pulp, may also be used.

The thickness of the substrate may suitably be selected depending upon the particular application, but is preferably from 60 to 250 g/m$^2$, particularly preferably from 100 to 230 g/m$^2$, as weighed. To the above substrate, various additives, such as a filler, a sizing agent, a paper strength increasing agent, a pH controlling agent, and a yield-improving agent, may be incorporated.

The surface condition of the substrate is not particularly limited. However, in some cases, it is influential over the condition of the ink receiving layer to be formed thereon. Accordingly, the surface is preferably one having a certain specific smoothness and a certain specific Stockigt sizing degree. Namely, it is preferably one having a Oken type smoothness (defined by JAPAN TAPPI No. 5-2) of from 30 to 50 seconds and a Stockigt sizing degree of from 30 to 2,000 seconds. If the Oken type smoothness of the surface of the substrate is less than 30 seconds, the smoothness of the ink receiving layer surface tends to be low. On the other hand, if the Oken type smoothness exceeds 2,000 seconds, the smoothness of the ink receiving layer surface tends to be high. Likewise if the Stockigt sizing degree is less than 30 seconds, the smoothness of the ink receiving layer surface tends to be low. On the other hand, if the Stockigt sizing degree exceeds 2,000 seconds, the smoothness of the ink receiving layer surface tends to be high. It is particularly preferred that the Oken type smoothness is from 30 to 150 seconds, and the Stockigt sizing degree is from 30 to 1,000 seconds.

In the present invention, the porous ink receiving layer formed on the substrate, comprises a pigment and a binder, and it is required that the average roughness Ra of the surface in accordance with JIS B0601 is from 0.2 to 2.0 μm. Here, the average roughness is an arithmetic average roughness obtained by a measuring method disclosed in JIS B0601 with a cutoff value ($\lambda_c$) being 0.8 mm and an evaluation length ($L_n$) being 4 mm. As mentioned above, if such an average roughness is less than 0.2 μm, no adequate fixing property of pigment particles of the colorant tends to be obtained, and the particles tend to fall off even by slight abrasion, and a bronzing phenomenon is likely to result. On the other hand, if the average roughness exceeds 2.0 μm, only pigment particles of the colorant are likely to be exposed on the surface, whereby the developed color density tends to be low. It has been found that within the above range, the average roughness is particularly preferably from 0.3 to 1.0 μm, whereby particularly preferred characteristics can be obtained.

The surface roughness of the ink receiving layer may be brought into the above range by various means including e.g. the particle sizes or amounts of the pigment and the binder to form the ink receiving layer, the method for coating the ink receiving layer, and treatment for smoothing after forming the ink receiving layer. It is particularly preferred to control the average particle diameter of pigments to form the ink receiving layer, and to treat the surface after forming the ink receiving layer by a roll having a suitable surface roughness.

In the present invention, the porous ink receiving layer formed on the substrate is made of a layer comprising a pigment and a binder, and the surface of the ink receiving layer is required to have a specular gloss at 20° of from 2 to 18% and a distinctness of image gloss of at most 20. The specular gloss at 20° is a specular gloss at 20° as stipulated in JIS Z8741. If the specular gloss at 20° is lower than 2%, the developed color density tends to be low. On the other hand, if the specular gloss at 20° is higher than 18%, the fixing property of the pigment ink tends to be inadequate, and depending upon the images, a bronzing phenomenon is likely to occur, whereby the object of the present invention can not be accomplished. The specular gloss at 20° C. is particularly preferably from 3 to 15%.

Further, in the present invention, the distinctness of image gloss is required to be at most 20. The distinctness of image gloss is a print gloss as stipulated in ASTM E430. The distinctness of image gloss is calculated by the following formula. In the following formula, Rs is an output when the intensity of specular reflection light at a reflection angle of 30° is detected, and R(0.3°) is an output when the intensity of reflection light at ±0.3° on both sides of the peak angle of the specular reflection light, is detected. Rs and R(0.3°) are outputs of the respective reflection lights obtained by means of a slit as stipulated in ASTM E430.

$$\text{Distinctness of image gloss}=[1-R(0.3°)/Rs]\times 100$$

In the present invention, if such a distinctness of image gloss is higher than 20, the fixing property of the pigment ink tends to be inadequate, and depending upon the images, a bronzing phenomenon is likely to occur, whereby the object of the present invention can not be accomplished. The distinctness of image gloss is particularly preferably from 2 to 15.

In the present invention, when the specular gloss at 20° and the distinctness of image gloss of the surface of the ink receiving layer are adjusted to be within the above ranges, the surface of the ink receiving layer will have a suitable surface roughness for the pigment ink. In the present invention, the ink receiving layer preferably has a surface roughness Ra of from 0.2 to 2.0 μm as stipulated in JIS B0601. Here, the average roughness is an arithmetic average roughness as measured by the measuring method disclosed in JIS B0601 with a cutoff value ($\lambda_c$) being 0.8 mm and an evaluation length ($l_n$) being 4 mm. As mentioned above, if such an average roughness Ra is less than 0.2 μm, no adequate fixing property of pigment particles of the colorant tends to be obtained, and the pigment particles are likely to fall off even by slight abrasion, and a bronzing phenomenon is likely to occur. On the other hand, if the average roughness Ra exceeds 2.0 μm, only pigment particles of the colorant will be exposed on the surface, whereby the developed color density tends to be low. Within the above range, the surface roughness is particularly preferably from 0.3 to 1.0 μm, whereby particularly preferred characteristics can be obtained.

In the present invention, the specular gloss at 20° and the distinctness of image gloss of the surface of the ink receiving layer can be adjusted to be within the above ranges by various means including e.g. the particle sizes or amounts of the pigment and the binder to form the ink receiving layer, the method for coating the ink receiving layer and treatment for smoothing after formation of the ink receiving layer. It is particularly preferred to control the average particle diameter of the pigment to form the ink receiving layer and to treat the surface after forming the ink receiving layer by a roll having a suitable surface roughness.

As the pigment which forms the porous ink receiving layer, various types of pigments may be used. However, from the above-described necessity to control the surface roughness, the average particle diameter of the pigment is preferably at most 1 μm. If the average particle diameter exceeds 1 μm, the surface roughness of the ink receiving layer tends to be large, and it tends to be difficult to control the surface roughness within the above-mentioned range. The average particle diameter of the pigment is more preferably from 0.05 to 0.5 μm. Here, the average particle diameter is a value obtained by a laser scattering method.

As the pigment which forms the ink receiving layer, various types of pigments may be used. For example, colloidal silica, alumina, alumina hydrate, synthetic fine particulate silica, synthetic fine particulate alumina silicate, gas phase method synthetic silica, zeolite, montmorillonite group mineral, beidellite group mineral, saponite group mineral, hectorite group mineral, stevensite group mineral, hydrotalcite group mineral, smectite group mineral, bentonite group mineral, calcium carbonate, magnesium carbonate, calcium sulfate, barium sulfate, titanium oxide, titania sol, zinc oxide, zinc carbonate, aluminum silicate, calcium silicate, magnesium silicate, kaolin, talc, aluminum oxide, aluminum hydroxide, a polyaluminum hydroxide compound, a plastic pigment, a urea resin pigment, cellulose particles and starch particles. Among them, alumina hydrate is preferred, and further, from the excellent ink absorptivity and fixing property, boehmite ($Al_2O_3 \cdot nH_2O$, n=1 to 1.5) is preferred.

Further, as the above binder which forms the ink receiving layer, a water-soluble polymer, an alcohol-soluble polymer or a mixture of these polymers, may be employed, for example, gelatin, starch or its modified product, polyvinyl alcohol or its modified product, polyvinyl pyrrolidone, styrene/butadiene rubber latex, nitrile/butadiene rubber latex, methyl cellulose, carboxymethyl cellulose, hydroxy cellulose, hydroxymethyl cellulose, polyacrylic acid or polyacrylamide.

Among them, in the present invention, it is particularly preferred to employ polyvinyl alcohol or its modified product, since the ink absorptivity and water resistance are thereby excellent. The binder is contained in the ink receiving layer preferably in an amount of from 1 to 30 parts by mass, particularly preferably from 3 to 15 parts by mass, per 100 parts by mass of the above pigment.

As a method for forming the ink receiving layer on the surface of the substrate, a method may, for example, be employed wherein the binder is added to the pigment to obtain a slurry, and the slurry is coated by means of e.g. a roll coater, an air knife coater, a blade coater, a rod coater, a bar coater, a comma coater, a gravure coater, a die coater, a curtain coater, a spray coater or a slide coater, followed by drying.

The ink receiving layer in the present invention, thus formed, preferably has a pore structure such that the average pore radius is from 3 to 25 nm, and the pore volume is from 0.3 to 2.0 $cm^3/g$, so that it has adequate ink absorptivity and transparency. When the ink receiving layer has such pore characteristics, absorptivity of the ink receiving layer for the medium in the pigment ink can be made high, whereby excellent prints and images can be obtained. Particularly preferably, the average pore radius is from 6 to 20 nm, and the pore volume is from 0.5 to 1.5 $cm^3/g$. Further, pore radii of the ink receiving layer preferably have not only the above-mentioned average pore radius but also a distribution substantially within a range of from 1 to 50 nm. Here, the pore radius distribution in the present invention is measured by a nitrogen absorption/desorption method.

Further, the thickness of the ink receiving layer may suitably be selected also depending upon the type of the printer to be used, but is usually preferably from 5 to 100 $\mu$m. If the thickness is less than the above range, the solvent in the ink may not adequately be absorbed. On the other hand, if the thickness exceeds the above range, the transparency is likely to be impaired, or the strength of the ink receiving layer tends to be low. Particularly preferably, the thickness of the ink receiving layer is from 10 to 50 $\mu$m.

Various treatments may be applied to the ink jet recording medium of the present invention, as the case requires. For example, by applying smoothing treatment such as calender treatment, the surface roughness of the ink receiving layer may be controlled at this stage. Further, on the surface of the ink receiving layer of the recording medium, a surface layer to protect the ink receiving layer, which contains e.g. colloidal silica, may be formed, or between the substrate and the ink receiving layer, a suitable interlayer may be provided. In such a case, particularly in a case where a surface layer is provided, it is necessary to make the surface roughness to be within the range specified by the present invention, and the thickness and the particle size to be used for the surface layer are controlled. Further, on the surface of the substrate opposite to the side having the ink receiving layer, various types of rear side coating layers may be provided to prevent curling or to improve the transportation efficiency of the sheet.

As the pigment ink to be used for ink jet printing on the recording medium of the present invention, a pigment ink of a resin-dissolved type having a pigment and a water-soluble resin as a dispersant dispersed in an aqueous medium such as water, or a microencapsulated ink having, dispersed in an aqueous medium such as water, microcapsules having a pigment encapsulated with a film-forming resin, may be employed. Among them, in the present invention, it is particularly preferred to use the latter microencapsulated pigment ink, since the dispersion stability of the ink is excellent, and when the pigment ink is jetted to the recording medium, as the pigment is covered with a resin, a resin film is formed on the surface of pigment particles, whereby prints and images having high gloss can be obtained. The pigment in the pigment ink is preferably contained in an amount of from 0.5 to 20 mass %, particularly preferably from 2 to 12 mass % in the ink. To the pigment ink, a dispersant, an antioxidant or a viscosity-controlling agent, may, for example, be added as the case requires.

As the pigment contained in the pigment ink, various inorganic pigments or organic pigments may be used. As the inorganic pigments, pigments such as an oxide type pigment of e.g. a titanium oxide type, a cadnium oxide type, an iron oxide type, a chromic acid type or a silicic acid type, a sulfide type pigment, a carbonate type pigment, a metal complex type pigment, and carbon black, may, for example, be mentioned. As the organic pigments, pigments of e.g. an azo type, an anthraquinone type, a phthalocyanine type, a quinacridone type, an isoindoline type, a dioxazine type, a perinone type, a perylene type, isodigo type, a quinophthalone type and a diketopyrolopyrrole type, may, for example, be mentioned.

As the microencapsulated pigment ink which is preferably used in the present invention, a pigment ink having encapsulated self water dispersible resin pigment particles having an acid value of from 50 to 280 mg-KOH/g and having at least 60 mol % of acid groups neutralized with a base such as alcohol amine, is preferred, said pigment particles having an average particle diameter of preferably from 10 to 100 nm. In this case, as the self water-dispersible resin, a styrene type resin, an acrylic type resin, a polyester type resin or a polyurethane type resin may, for example, be used.

In the present invention, a method for ink jet printing on the above-described ink jet recording medium by using a pigment ink, is not particularly limited, and by using an ink jet printer of a piezo system or a thermal system, full color prints or images can be obtained.

Now, the present invention will be described in further detail with reference to Examples. However, it should be understood that the present invention is by no means restricted to such specific Examples. Here, Examples 1 to 3 and 6 to 8 are Working Examples of the present invention, and Examples 4, 5, 9 and 10 are Comparative Examples. In the Examples, "parts" means "parts by mass" unless otherwise specified.

EXAMPLE 1

85 Parts of bleached craft pulp of hardwood and 15 parts of bleached craft pulp of softwood were beaten until the beating degree became 320 CSF (Canadian standard filtered water degree). Then, 15 parts of light calcium carbonate, 1.0 part of cationic starch and 0.1 part of alkenylsuccinic anhydride type neutral sizing agent were added and thoroughly mixed thereto to obtain a paper slurry.

Then, the above paper slurry was sheeted by means of a Foundrinier machine, and then, on both sides thereof, a 5% aqueous solution of oxidized starch was coated in an amount of 5 $g/m^2$ by a size press machine, followed by drying until the water content became 7%, to obtain a woodfree paper having a weight of 157 $g/m^2$. Such a woodfree paper had a Oken type smoothness of 60 seconds and a Stockigt sizing degree of 70 seconds. On the surface of one side of this woodfree paper, the following ink receiving layer formulation 1 was coated by a bar coater so that the thickness of the coating layer after drying would be 20 $\mu$m, and then dried at 120° C. to obtain an ink jet recording paper. Here, the alumina sol used in the following ink receiving layer formulation 1 was prepared by adding a sodium aluminate solution to a liquid comprising polyaluminum chloride and water, heated to 95° C., followed by aging to obtain a slurry, washing the aged slurry with deionized water, heating it again to 95° C., adding acetic acid to carry out peptization and concentration, followed by ultrasonic treatment to obtain the alumina sol.

Ink Receiving Layer Formulation 1

100 Parts of alumina sol (alumina sol prepared as described above, average particle size: 0.2 μm), and 10 parts of polyvinyl alcohol (tradename PA-124, manufactured by Kuraray Corporation)

With the recording sheet thus obtained, the average surface roughness Ra of the ink receiving layer was 0.56 μm. Further, the ink receiving layer had a pore volume of 0.69 $cm^3/g$ and an average pore radius of 9.8 nm.

EXAMPLE 2

The surface of the ink receiving layer of the ink jet recording paper obtained in Example 1 was subjected to super calender treatment (line speed: 5 m/min, roll temperature: 20° C., nip pressure: 50 kN/m) by a mini super calender (manufactured by Yuri Roll Kikai K.K.) to bring the average roughness of the surface of the ink receiving layer to 0.34 μm.

EXAMPLE 3

On the surface of the ink receiving layer of the ink jet recording paper obtained in Example 1, the following coating layer formulation 1 was coated in the same manner as in Example 1 so that the thickness of the coated layer after drying would be 1 μm, followed by drying to obtain an ink jet recording paper having an ink receiving layer having a protective coating layer on its surface.

Coating Layer Formulation 1

100 Parts of colloidal silica (tradename Cataloid S1-45P, manufactured by Shokubai Kasei K.K., average particle size: 45 nm), and 100 parts of colloidal silica composite polymer (tradename Mobile 8050, manufactured by Clariant Polymer Co.)

With the recording medium thus obtained, the average surface roughness Ra of the ink receiving layer was measured and found to be 0.44 μm.

EXAMPLE 4

An ink jet recording paper was prepared in the same manner as in Example 1 except that instead of the ink receiving layer formulation 1, the following ink receiving layer formulation 2 was used so that the thickness of the coating layer after drying would be 20 μm.

Ink Receiving Layer Formulation 2

100 Parts of amorphous silica (tradename P78A, manufactured by Mizusawa Kagaku K.K., average particle size: 3.3 μm), and 40 parts of polyvinyl alcohol (tradename R-1130, manufactured by Kuraray Corporation)

With the obtained recording sheet, the surface roughness Ra of the ink receiving layer thereof was 3.54 μm, and the ink receiving layer had a pore volume of 1.08 $cm^3/g$ and an average pore radius of 8.5 nm.

EXAMPLE 5

On the front side of the same woodfree paper as used in Example 1, a mixture comprising 70 parts of a low density polyethylene resin, 20 parts of a high density polyethylene resin and 10 parts of titanium oxide, was melt-extrusion coated, and on the rear side, a mixture comprising 50 parts of a low density polyethylene resin and 50 parts of a high density polyethylene resin, was melt extrusion coated, so that in each case, the coated amount would be 20 $g/m^2$, to obtain a sheet, and using this sheet as a substrate, the ink receiving layer formulation 1 was coated in the same manner as in Example 1 on the coating layer surface of the mixture comprising the high density polyethylene resin and the titanium oxide, on the front side, to obtain an ink jet recording medium having an ink receiving layer on its surface.

In the above recording medium, the surface of the coating layer of the mixture comprising the high density polyethylene resin and the titanium oxide on the front side of the substrate before coating the ink receiving layer, had a Oken type smoothness of 1,000 seconds, but the Stockigt sizing degree could not be measured, since the measuring liquid did not penetrate. Further, the average surface roughness of the ink receiving layer of the recording medium was 0.10 μm.

On the five types of ink jet recording papers of the above Examples 1 to 5, ink jet printing was carried out by using an ink jet printer for pigment ink (tradename MC-2000, manufactured by Seiko Epson K.K.) and using, as pigment inks, MC1BK01 (black) and MC5CL01 (color), which were microencapsulated pigment inks for the ink jet printer. With respect to the obtained recorded products, the developed color density, the ink fixing property, the ink absorptivity and the bronzing phenomenon were evaluated. The evaluation results are shown in Table 1.

Oken Type Smoothness

Measured in accordance with JAPAN TAPPI paper pulp test method No. 5B

Stockigt Sizing Degree

Measured in accordance with JIS P8122

Developed Color Density

Gradation solid printing of black, cyan, yellow and magenta was carried out, and the respective saturated reflection color density were measured.

Ink Fixing Property

Gradation solid printing of black, cyan, yellow and magenta was carried out. As a peeling test of ink, the print portions were abraded with a nail, and visual evaluation was carried out under the following standards.

○: No substantial peeling of ink was observed.

Δ: Ink slightly peeled.

X: Ink substantially peeled.

The evaluation results are shown in Table 1.

Ink Absorptivity

Gradation solid printing of black, cyan, yellow and magenta was carried out. The granular texture due to poor ink absorptivity of the solid printed portion, was visually evaluated by the following standards.

○: No granular texture was observed.

Δ: Granular texture slightly observed, but not practically problematic.

X: Granular texture is remarkable, and there is no practical usefulness.

Bronzing

Gradation solid printing of black, cyan, yellow and magenta was carried out. The bronzing phenomenon on the surface of the solid printed portion was visually observed.

○: No bronzing phenomenon observed.

X: Bronzing phenomenon observed.

TABLE 1

| Example | Surface roughness of the ink receiving layer | Developed color density Y/M/C/K | Ink fixing property | Ink absorptivity | Bronzing |
|---|---|---|---|---|---|
| 1 | 0.56 | 0.89/1.74/2.26/2.23 | ○ | ○ | ○ |
| 2 | 0.34 | 0.90/1.73/2.25/2.25 | ○ | Δ | ○ |
| 3 | 0.44 | 0.88/1.76/2.28/2.24 | Δ | ○ | ○ |
| 4 | 3.54 | 0.79/1.62/1.63/1.55 | ○ | ○ | ○ |
| 5 | 0.10 | 0.81/1.70/2.11/2.10 | X | Δ | X |

As is evident from Table 1, the ink jet recording papers of the present invention are excellent in the developed color density, the ink absorptivity and the ink fixing property, for a pigment ink.

EXAMPLE 6

On the surface of one side of the woodfree paper prepared as described in Example 1, the following ink receiving layer formulation 3 was coated by means of a bar coater so that the thickness of the coated layer after drying would be 15 μm, followed by drying at 120° C. to obtain an ink jet recording paper. Here, the alumina sol used for the following ink receiving layer formulation 1 was prepared by adding a sodium aluminate solution to a liquid comprising polyaluminum chloride and water, heated to 95° C., followed by aging to obtain a slurry, washing the aged slurry with deionized water, raising the temperature again to 95° C., adding acetic acid to carry out peptization and concentration, followed by ultrasonic treatment to obtain the alumina sol.

Ink Receiving Layer Formulation 3

100 Parts of alumina sol (alumina sol prepared as described above, average particle size: 0.2 μm), and 10 parts of polyvinyl alcohol (tradename Gosenol NH-18, manufactured by Nippon Gosei Kagaku K.K.).

With the recording sheet thus obtained, the specular gloss at 20° of the surface of the ink receiving layer was 4.5%, and the distinctness of image gloss was 6.0. Further, the ink receiving layer had a surface roughness (Ra) of 0.72 μm, a pore volume of 0.72 $cm^3/g$ and an average pore radius of 10.1 nm.

EXAMPLE 7

Super calender treatment (line speed: 5 m/min, roll temperature: 20° C., nip pressure: 50 kN/m) was applied to the surface of the ink receiving layer of the ink jet recording paper obtained in Example 6 by a mini super calender (manufactured by Yuri Roll Kikai K.K.). By such a treatment, the specular gloss at 20° of the surface of the ink receiving layer was 8.1%, the distinctness of image gloss was 6.6, and the surface roughness (Ra) was 0.46 μm.

EXAMPLE 8

On the surface of the ink receiving layer of the ink jet recording paper obtained in Example 6, the following coating layer formulation 1 was coated in the same manner as in Example 6 so that the thickness of the coated layer after drying would be 1 μm, followed by drying to obtain an ink jet recording paper having an ink receiving layer provided with a protective coating layer on its surface.

With the recording paper thus obtained, the specular gloss at 20° of the surface of the ink receiving layer was 12.5%, the distinctness of image gloss was 4.4, and the surface roughness (Ra) was 0.61 μm.

EXAMPLE 9

An ink jet recording paper was prepared in the same manner as in Example 6 except that instead of the ink receiving layer formulation 3, the following ink receiving layer formulation 4 was used, so that the thickness of the coated layer after drying would be 15 μm.

Ink Receiving Layer Formulation 4

100 Parts of amorphous silica (tradename Finesil X-37, manufactured by Tokuyama K.K., average particle size: 2.7 μm), and 40 parts of polyvinyl alcohol (tradename R-1130, manufactured by Kuraray Corporation).

With the recording paper thus obtained, the specular gloss at 20° of the ink receiving layer was 1.4%, and the distinctness of image gloss was 28.4. Further, the ink receiving layer had a surface roughness of (Ra) of 3.63 μm, a pore volume of 1.01 $cm^3/g$ and an average pore radius of 8.6 nm.

EXAMPLE 10

On the front side of the same woodfree paper as used in Example 6, a mixture comprising 70 parts of a low density polyethylene resin, 20 parts of a high density polyethylene resin and 10 parts of titanium oxide, was coated, and on the rear side surface, a mixture comprising 50 parts of a low density polyethylene resin and 50 parts of a high density polyethylene resin, was coated, by melt extrusion so that in each case, the coated amount would be 20 $g/m^2$, and the sheet thereby obtained was used as a substrate. On the coated layer surface of the mixture comprising a high density polyethylene resin and titanium oxide on the front side, The ink receiving layer formulation 3 was coated in the same manner as in Example 6, to obtain an ink jet recording paper having an ink receiving layer on its surface.

In the above recording paper, the surface of the coated layer of the mixture comprising a high density polyethylene resin and titanium oxide on the front side of the substrate, before coating the ink receiving layer had a Oken type smoothness of 1,000 seconds, but it was impossible to measure the Stockigt sizing degree, since the measuring liquid did not penetrate. Further, the specular gloss at 20° of the surface of the ink receiving layer of the recording paper was 18.6%, the distinctness of image gloss was 43.3, and the surface roughness (Ra) was 0.10 μm.

To the five types of ink jet recording papers of the above Examples 6 to 10, ink jet printing was carried out by using an ink jet printer for pigment ink (tradename MC-2000, manufactured by Seiko Epson K.K.) and employing, as pigment inks, a microencapsulated pigment ink prepared as described hereinafter and MC5CL01 (color) as a microencapsulated pigment ink for the above-mentioned ink jet printer, and with respect to the recorded products thereby obtained, the developed color density, the ink fixing property, the ink absorptivity and the bronzing phenomenon were evaluated. The evaluation results are shown in Table 2. Here, "specular gloss at 20°" and "distinctness of image gloss" of the ink receiving layer, were measured, respectively, as follows. Other properties were measured in the same manner as in Examples 1 to 5.

Preparation of a Microencapsulated Pigment Ink

A mixture comprising 20 parts of carbon black, 20 parts of a styrene/acrylic acid type copolymer resin (copolymer of styrene/methyl methacrylate/butyl acrylate/acrylic acid/2-ethylhexyl acrylate in a molar ratio of 60/20/10/7/3, molecular weight: 20,000, acid value: 55 mg-KOH/g), 60 parts of methyl ethyl ketone and 150 parts of glass beads, was kneaded for 4 hours in a mill. Then, 30 parts of methyl ethyl ketone and 40 parts of isopropyl alcohol were added thereto, and the mixture was taken out to obtain 170 parts of a mill base.

To 170 parts of the above mill base, 2.1 parts of N-methyldiethanolamine was added, and while stirring the mixture, a mixed liquid comprising 200 parts of glycerol and 600 parts of deionized water, was dropwise added at a rate of 5 ml per minute to obtain colored microcapsules. The obtained microcapsule liquid was treated by a rotary evaporator to distill off methyl ethyl ketone and isopropyl alcohol and to obtain an aqueous dispersion of colored microcapsules. This aqueous dispersion was subjected to filtration by means of a filter to obtain a microencapsulated pigment ink.

Specular Gloss at 20°

Obtained by the method in accordance with JIS Z8741 at a measuring angle of 20°.

Distinctness of Image Gloss

Obtained by the method in accordance with ASTM E430 by means of Distinctness of Image Glossmeter (tradename DGM-30 model, manufactured by Murakami Shikisai Gijutsu Kenkyusho).

TABLE 2

| Example | Specular gloss at 20° C. | Distinctness of image gloss | Developed color density Y/M/C/K | Ink fixing property | Ink absorptivity | Bronzing |
|---|---|---|---|---|---|---|
| 6 | 4.5 | 6.0 | 0.89/1.7/2.26/2.23 | ○ | ○ | ○ |
| 7 | 8.1 | 6.6 | 0.90/1.73/2.25/2.25 | ○ | Δ | ○ |
| 8 | 12.5 | 4.4 | 0.88/1.76/2.28/2.24 | Δ | ○ | ○ |
| 9 | 1.4 | 28.4 | 0.79/1.62/1.63/1.55 | ○ | ○ | ○ |
| 10 | 18.6 | 43.3 | 0.81/1.70/2.11/2.10 | X | Δ | X |

As is evident from Table 2, the ink jet recording papers of the present invention are excellent in each of the developed color density, the ink absorptivity, the ink fixing property and the bronzing phenomenon, for a pigment ink.

As described in the foregoing, according to the present invention, an ink jet recording medium for a pigment ink whereby the developed color density is high and the fixing property of a pigment ink in the ink receiving layer is sufficient without providing any special pigment fixing layer, while maintaining merits of using a pigment ink, such as light resistance, water resistance and little running, and a recording method using such an ink jet recording medium for pigment ink, can be provided.

The entire disclosures of Japanese Patent Application No. 2001-112679 filed on Apr. 11, 2001 and Japanese Patent Application No. 2001-129828 filed on Apr. 26, 2001 including specifications, claims, drawings and summaries are incorporated herein by reference in their entireties.

What is claimed is:

1. An ink jet recording medium for pigment ink, which comprises a substrate and a porous ink receiving layer for pigment ink, formed on the surface of the substrate, wherein the ink receiving layer comprises a pigment and a binder and has an average surface roughness (Ra) according to JIS B0601 of from 0.2 to 2.0 μm; and the surface of the ink receiving layer has a specular gloss in accordance with JIS Z8741 at 20° of from 2 to 18% and a distinctness of image gloss in accordance with ASTM E430of at most 20.

2. The ink jet recording medium for pigment ink according to claim 1, wherein the ink receiving layer has a thickness of from 5 to 100 μm, and the average particle diameter of the pigment contained therein is at most 1 μm.

3. The ink jet recording medium for pigment ink according to claim 1, wherein the ink receiving layer has an average pore radius of from 3 to 25 nm and a pore volume of from 0.3 to 2.0 $cm^3/g$.

4. The ink jet recording medium for pigment ink according to claim 1, wherein the pigment in the ink receiving layer is alumina hydrate.

5. The ink jet recording medium for pigment ink according to claim 1, wherein the pigment ink is a microencapsulated ink having, dispersed in an aqueous medium, microcapsules having a coloring pigment encapsulated with a film-forming resin having an acid value of from 50 to 280 mg-KOH/g and having some of acid radicals neutralized.

6. An ink jet recording medium for pigment ink, which comprises a substrate and a porous ink receiving layer for pigment ink, formed on the surface of the substrate, wherein the ink receiving layer comprises a pigment and a binder, and the surface of the ink receiving layer has a specular gloss in accordance with JIS Z8741 at 200 of from 2 to 18% and a distinctness of image gloss in accordance with ASTM E430 of at most 20.

7. The ink jet recording medium for pigment ink according to claim 6, wherein the ink receiving layer has a thickness of from 5 to 100 μm, and the average particle diameter of the pigment contained therein is at most 1 μm.

8. The ink jet recording medium for pigment ink according to claim 6, wherein the ink receiving layer has an average pore radius of from 3 to 25 nm and a pore volume of from 0.3 to 2.0 $cm^3/g$.

9. The ink jet recording medium for pigment ink according to claim 6, wherein the pigment in the ink receiving layer is alumina hydrate.

10. The ink jet recording medium for pigment ink according to claim 6, wherein the pigment ink is a microencapsulated ink having, dispersed in an aqueous medium, microcapsules having a coloring pigment encapsulated with a film-forming resin having an acid value of from 50 to 280 mg-KOH/g and having some ofacd radicals neutralized.

* * * * *